US006431488B1

(12) United States Patent
Zemla et al.

(10) Patent No.: US 6,431,488 B1
(45) Date of Patent: Aug. 13, 2002

(54) DUAL DRIVE POOL COVER

(75) Inventors: Corinne M. Zemla, Long Beach; Greg M. Rhoads, Irvine, both of CA (US)

(73) Assignee: Poolsaver, Inc., Walnut, CA (US)

( * ) Notice: Subject to any disclaimer, the term of this patent is extended or adjusted under 35 U.S.C. 154(b) by 0 days.

(21) Appl. No.: 09/556,234

(22) Filed: Apr. 24, 2000

(51) Int. Cl.[7] ..... B65H 75/38

(52) U.S. Cl. ..... 242/388.6; 242/390.2; 4/502

(58) Field of Search ..... 242/388.6, 918, 242/390.2, 390.8; 4/502

(56) References Cited

U.S. PATENT DOCUMENTS

| | | | | | |
|---|---|---|---|---|---|
| 3,940,809 | A | | 3/1976 | Hughes | 4/172.12 |
| 3,979,782 | A | | 9/1976 | Lamb | 4/172.14 |
| 3,982,286 | A | | 9/1976 | Foster | 4/172.14 |
| 4,001,900 | A | | 1/1977 | Lamb | 4/172.14 |
| 4,011,607 | A | | 3/1977 | Davidoff | 4/172.12 |
| 4,059,855 | A | | 11/1977 | Riendeau | 4/172.14 |
| 4,060,860 | A | | 12/1977 | Lamb | 4/172.14 |
| 4,116,745 | A | | 9/1978 | Lambert | 156/362 |
| 4,181,986 | A | | 1/1980 | Aine | 4/172.14 |
| 4,195,370 | A | | 4/1980 | Budd | 4/172.14 |
| 4,203,174 | A | | 5/1980 | Shults | 4/172 |
| 4,251,889 | A | | 2/1981 | Löf | 4/498 |
| 4,262,373 | A | | 4/1981 | Chambers | 4/502 |
| 4,285,078 | A | | 8/1981 | Batstone | 4/661 |
| 4,459,711 | A | | 7/1984 | Sartain et al. | 4/502 |
| 4,464,801 | A | | 8/1984 | Lamb | 4/502 |
| 4,466,143 | A | | 8/1984 | Lamb | 4/502 |
| 4,466,144 | A | | 8/1984 | Lamb | 4/503 |
| 4,494,256 | A | * | 1/1985 | Radtke et al. | 4/502 |
| 4,683,686 | A | | 8/1987 | Ozdemir | 52/64 |
| 4,790,037 | A | | 12/1988 | Phillips | 4/499 |
| 4,858,253 | A | | 8/1989 | Lamb | 4/502 |
| 4,939,798 | A | | 7/1990 | Last | 4/502 |
| 4,953,269 | A | | 9/1990 | Ragsdale | 24/704.1 |
| 4,955,092 | A | | 9/1990 | Hagan | 4/502 |
| 5,044,022 | A | | 9/1991 | Hess | 4/502 |
| 5,065,461 | A | | 11/1991 | Shehan et al. | 4/503 |
| 5,067,184 | A | | 11/1991 | Last | 4/502 |
| 5,067,213 | A | | 11/1991 | Ragsdale et al. | 24/704.1 |
| 5,105,481 | A | | 4/1992 | Lamb et al. | 4/502 |
| 5,107,552 | A | | 4/1992 | Lavallière et al. | 4/502 |
| 5,184,356 | A | | 2/1993 | Löf et al. | 4/502 |
| 5,184,357 | A | | 2/1993 | Last | 4/502 |
| 5,184,377 | A | | 2/1993 | Ragsdale et al. | 24/704.1 |
| 5,282,282 | A | | 2/1994 | Shehan et al. | 4/503 |
| 5,327,590 | A | | 7/1994 | Last | 4/502 |
| 5,349,707 | A | | 9/1994 | Last | 4/502 |
| 5,426,899 | A | | 6/1995 | Jones | 52/63 |
| 5,524,302 | A | | 6/1996 | Ragsdale et al. | 4/502 |
| 5,555,574 | A | | 9/1996 | Wason et al. | 4/502 |
| 5,606,749 | A | | 3/1997 | Lavallière et al. | 4/502 |
| 5,608,926 | A | | 3/1997 | Donaton | 4/503 |
| 5,621,926 | A | | 4/1997 | La Madeleine | 4/498 |
| 5,701,613 | A | | 12/1997 | Richardson | 4/502 |
| 5,799,342 | A | | 9/1998 | Last | 4/502 |
| 5,845,343 | A | | 12/1998 | Last | 4/502 |
| 5,901,770 | A | | 5/1999 | Belpaume et al. | 160/133 |
| 5,913,613 | A | | 6/1999 | Ragsdale et al. | 4/502 |
| 5,920,922 | A | | 7/1999 | Ragsdale et al. | 4/502 |
| 5,930,848 | A | | 8/1999 | Last | 4/502 |
| 6,026,522 | A | * | 2/2000 | Last | 4/502 |

* cited by examiner

*Primary Examiner*—Emmanuel M. Marcelo
(74) *Attorney, Agent, or Firm*—Christie, Parker & Hale, LLP

(57) ABSTRACT

A motorized pool cover system, having a drum assembly and a reel assembly, located proximate one another, with a reversible electric motor coupled to each, and a pool cover, having a first end coupled to the drum assembly, and side edges with lines extending from the side edges and coupled to the reel assembly, and a controller, which is electrically coupled to the motors, and to an electrical power source, wherein the motor controller distributes power to the motors and controls operation of the motors.

18 Claims, 7 Drawing Sheets

DUAL DRIVE POOL COVER

BACKGROUND OF THE INVENTION

This invention is related to cover systems for pools and spas, and more specifically, to a motorized pool cover system utilizing at least two motors.

Typically, previous pool cover systems used a complicated system of pulleys and mechanical linkages to facilitate the movement of a pool cover between an open and closed position. In the open position, the pool cover was generally stored at one end of the pool, rolled up on a drum. From each side edge of the pool cover ran a cable. These two cables traveled to the far end of the pool, generally in an enclosed track. At the far end of the pool, each cable was routed around a pulley, then routed back to the near end of the pool, where the cables were received by one or more take up reels. To move the cover from its open position to its closed position, the cables would be wound onto the reels, thereby unwinding the stored pool cover from the drum, and pulling it through the enclosed track assembly, toward the opposite end of the pool. Typically, the edges of the pool cover would follow along in the same enclosed track as the cables until the cover was stretched across the pool to the far end, in its fully closed position. The take up reels for storing the cables, and the drum for storing the pool cover typically rotated about the same axis, and sometimes were even located on a common drive shaft. In the motorized systems, a single motor was generally utilized with a clutch or transmission system so that the motor could engage either the reels or the drum, with the non-engaged component "free-wheeling". One engagement system used concentric sleeves about a shaft, linking both the reels and the drum to a common shaft and motor.

Mechanical braking systems were also utilized to maintain tension on the cover and the cables. For example, when the motor was engaged to the reels, turning the reels to wind up the cables, thereby unwinding the cover from the drum and pulling the pool cover closed, a braking system applied pressure to the drum to maintain proper tension in both the pool cover and the cables.

In other systems, a spring-biased compensator system was utilized to equalize the forces on the sides of the cover and the cables, to ensure that the cover was wound straight on the drum.

Previously, pool cover systems generally required limit switches for proper operation of the cover, to ensure that the cover would open fully or close fully, without moving too far or damaging the pool cover. When the cover passed a specified position, a limit switch was tripped and the cover was either stopped or reversed. In addition, safety systems were used to stop the movement of the cover in the event that the cover encountered an obstruction. A commonly used method was to integrate a shear pin into the drive mechanism so to limit the force which could be exerted on the cover. When an obstruction was encountered, the system would push against the obstruction until the force was great enough to break the shear pin. The system would then be inoperable until a service call was made and the shear pin replaced. Both of these systems required additional mechanical components in the cover system, as well as additional necessary electrical contacts and/or switches.

In another previous system, two motors were utilized, with one motor located at each end of the pool. This, however, necessitated below-surface installations at each end of the pool, requiring additional space, additional wiring, and generating additional costs. In addition to the need for a motor housing area at each end of the pool, this system also required that a power source for each motor be routed to each end of the pool, again increasing installation costs. Another system utilized multiple hydraulic motors, with a motor for the reel, and a motor for the drum. However, installation of a hydraulic system is generally more costly than the installation of a comparable electric system, because in addition to installing the motors, reels and drum, a hydraulic system also requires a hydraulic power source, and a distribution system for the hydraulic fluid displaced by the hydraulic power source. Typically, the piping or tubing required for the hydraulic fluid distribution system would be somewhat complicated, take up additional space, and raise reliability questions, as the hydraulic fluid distribution system would be recessed, and any leakages of hydraulic fluid would necessitate access to the recessed distribution system. In addition, given the possibility of leakage, the use of hydraulic fluids in close proximity to the swimming pool water may also cause safety concerns.

Another requirement common to most previous cover systems was the requirement of precise alignment of the drum and reel portions, to facilitate the use of a common drive shaft. Thus the time and expense of installation was increased, as the reel and drum portions had to be carefully aligned to ensure proper operation of the cover, including the drive, engagement and braking systems.

Further, given the naturally moist environment around swimming pools, the use of complicated mechanical clutches, transmissions, concentric sleeves and other engagement systems, along with mechanical braking systems, spring-equipped compensator systems, and electrical contacts and switches, could result in rusted components which may bind, seize, and/or otherwise not perform as designed. Also, with the leaves and other debris which often accumulate in pool areas, proper operation of complicated mechanical systems could be prevented by foreign objects or debris.

Thus there exists the need for a motorized pool cover system which reduces the complexity and size of the installation, eliminates the need for complicated mechanical linkages and systems such as clutches, transmissions, sleeves and brakes, and provides simple, reliable and safe operation in covering and uncovering a pool.

SUMMARY OF THE INVENTION

The present invention is embodied in a dual drive pool cover system which utilizes a first motor coupled to a drum, and a second motor coupled to a reel, both located at one end of a pool. A cover is coupled at one end to the drum, and at the other end to first and second lines, which are coupled to the cover at one end and to the reel at the other end. An electronic controller is coupled to the motors to control them and provide power. This system provides simplified installation, reduced installation space requirements, simplified operation, and increased reliability by removing unnecessary mechanical driving, braking and safety hardware, by controlling the motors simultaneously to open and close the pool cover, by automatically controlling tension, by automatically applying opening and closing limits, and by limiting the torque the motors apply to the cover, all with the motors installed in a relatively compact space at one end of the pool.

An important feature of this invention is that it reduces the space necessary for installation, as the motors are housed at one end of the pool, and preferably are small motors which are incorporated directly into the respective reel and drum assemblies.

Another important feature is the built-in tensioning system provided by the electronic motor controller. Both motors are used to open the cover, with one motor winding the cover onto the drum while the other motor unwinds the lines from the reel, providing tension as the lines leave the reel. Likewise, both motors are used to close the cover, with one motor turning the reel, thereby winding the lines onto the reel, while the other motor turns the drum, unwinding the cover and providing tension as the cover leaves the drum. The motors are electronically controlled to work together and maintain the proper tension on both the lines and the cover. In addition, by electronically controlling the motors to optimize the tension in the lines and the cover, the system minimizes the current required to open and close the pool cover.

The electronic motor controller also limits the torque the motors exert on the cover: when movement of the cover is obstructed, either during opening or closing of the cover, or when the cover reaches either its fully opened or fully closed position, the cover exerts only a specified amount of torque. The controller limits the current to the motor, thereby limiting the torque, and preventing the motor from causing damage or injury. In this same way, the controller acts as a limit switch to ensure that the cover fully opens and closes.

Another feature of the system is simplified alignment during installation. In addition to decreasing the space needed for installation, this system also decreases the time needed for installation, because the reel assembly and drum assembly are virtually self-aligning. Simple mounting assemblies attach the system to the end wall of the pool. The reel assembly and drum assembly are independently mounted, with the mounting assembly for the reel providing an adjustable mount for the drum assembly.

Another feature of the system is the simplified operation and control, and increased dependability of the electronic control loop, which utilizes a single controller to supply and adjust current to the motors, maintain tensions, and electronically control opening and closing of the cover system. The user simply chooses either open or close, and the controller regulates the simultaneous operation of the motors.

Other features and advantages of the present invention will become apparent from the following description of the preferred embodiments, taken in conjunction with the accompanying drawings, which illustrate, by way of example, the principles of the invention.

DESCRIPTION OF THE DRAWINGS

The details and features of the present invention may be more fully understood by referencing the detailed description and drawings, in which.

DETAILED DESCRIPTION OF THE INVENTION

Figure 1:
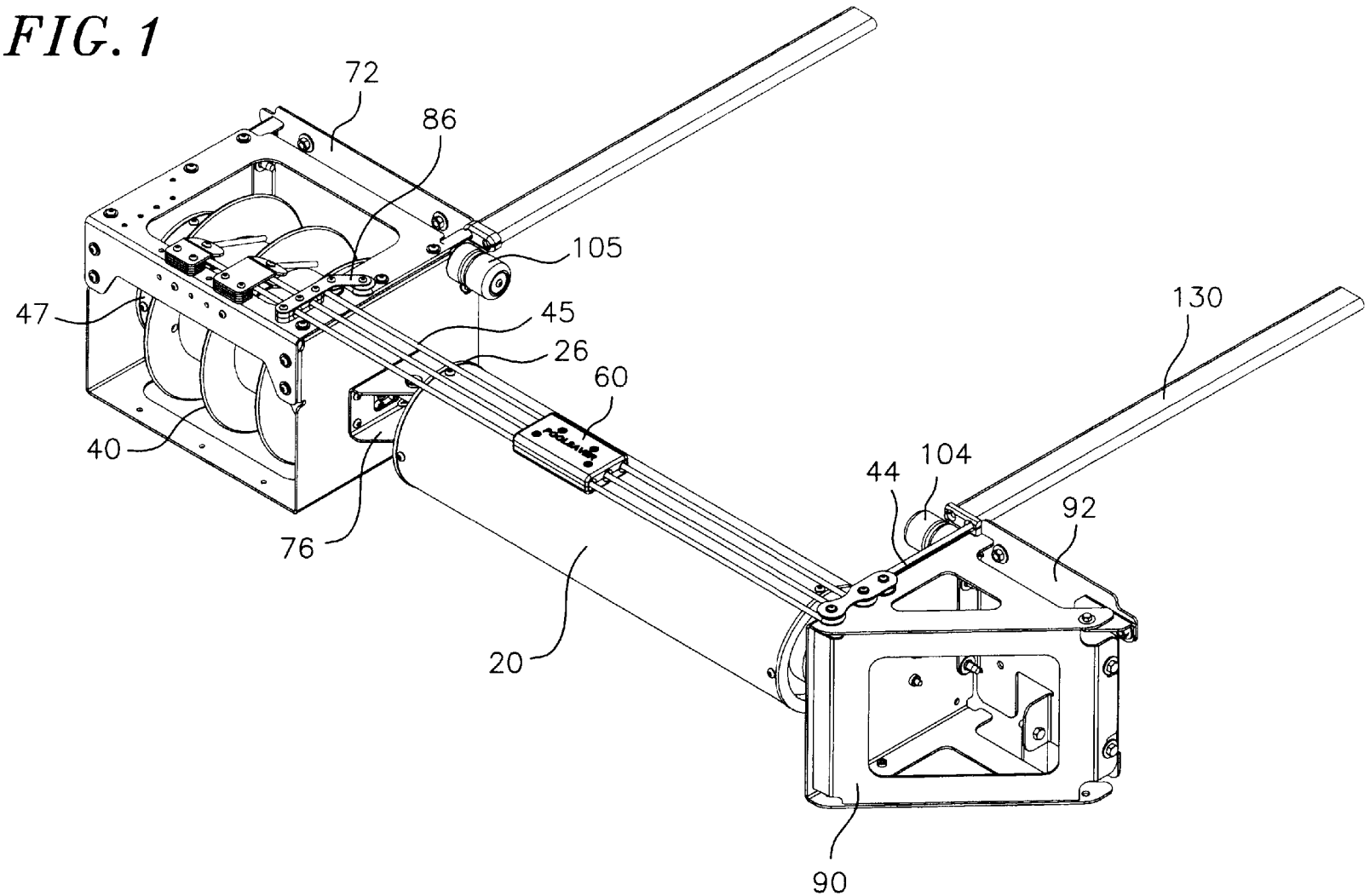
FIG. 1 is a perspective view of one embodiment of the present invention, including the drum assembly, the drum mounting assembly, the reel assembly, the reel mounting assembly, the cover and the lines.
Figure 6:
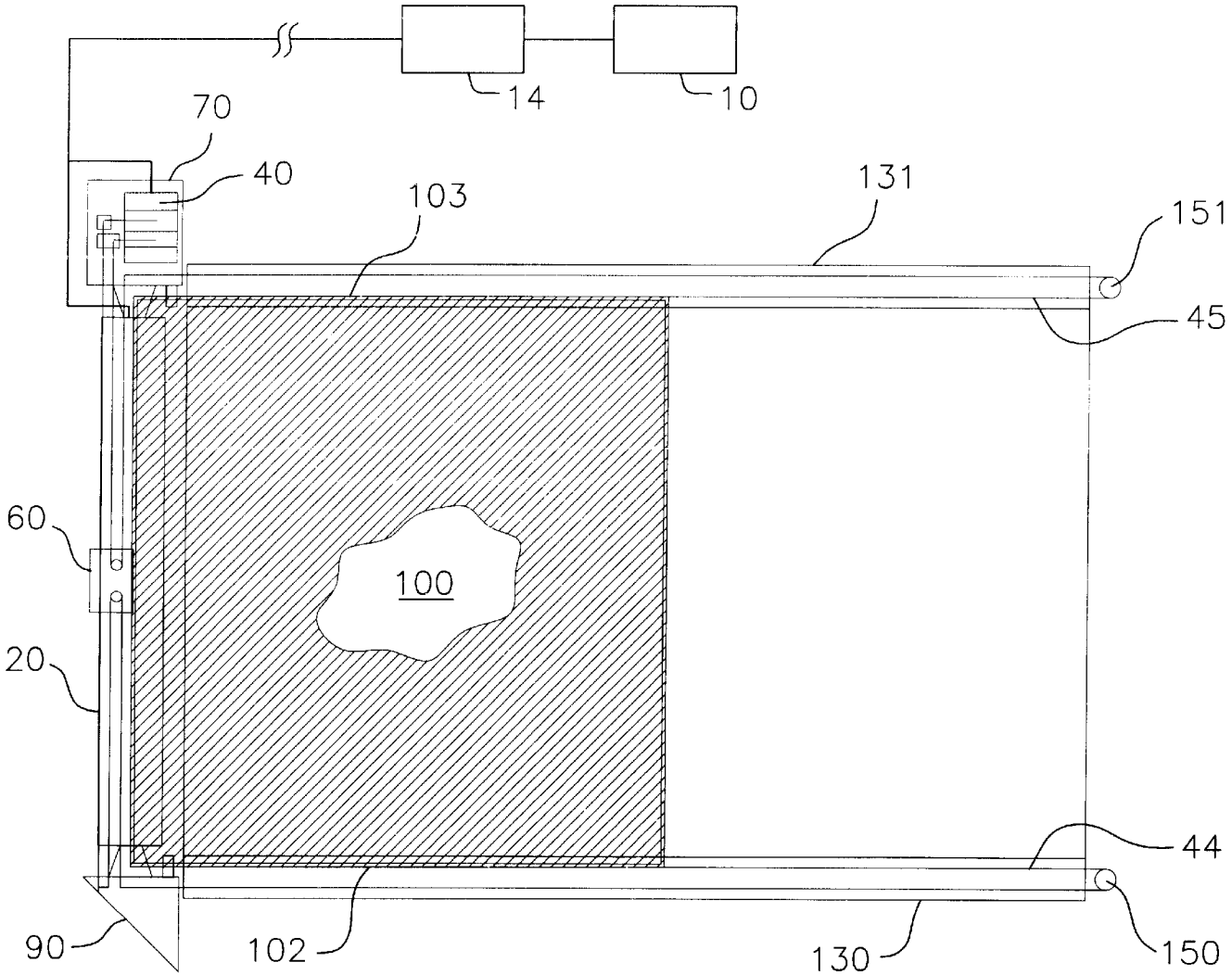
FIG. 6 is a schematic; view of one embodiment of the present invention.
Figure 7:
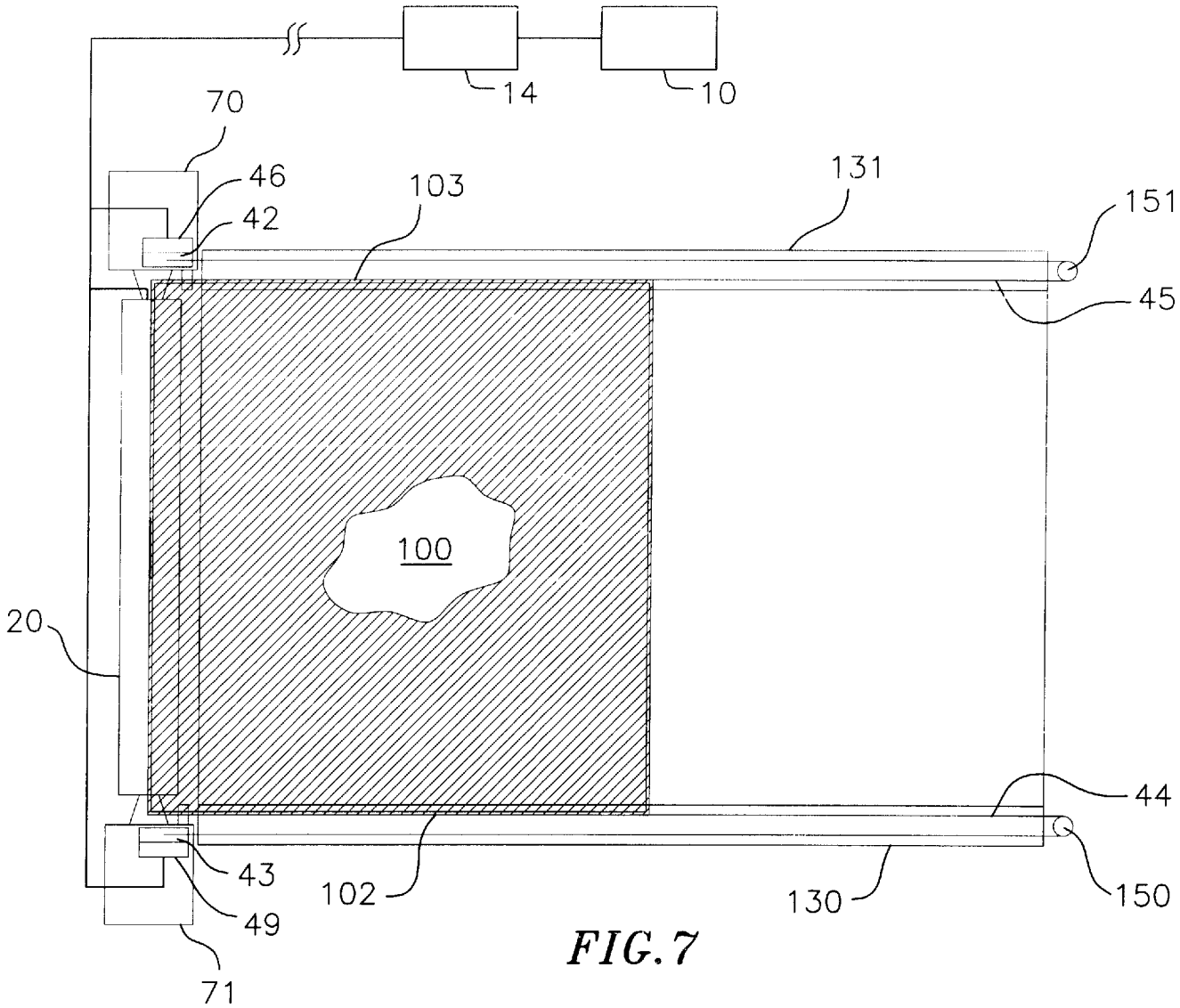
FIG. 7 is a schematic view of another embodiment of the present invention.

FIGS. 1 and 6 illustrate the interconnection of the reel assembly 40, reel mounting assembly 70, drum assembly 20, drum mounting assembly 90, and track assemblies 130, 131 in one embodiment of the pool cover system of the present invention. The term "pool cover" is used herein to describe a covering over a particular space. Although that space is generally a swimming pool, it could also include a different enclosed small body of water, such as a tub, spa or pond, or could also refer to non-water filled spaces over which this type of cover may also be used.

As shown in FIG. 6, the pool cover 100, when not covering the pool area, is stored on the drum assembly 20. The drum assembly 20 is located at one end of the pool. The pool cover 100 is shaped to match the perimeter of the pool. Preferably, the cover is rectangular. Parallel track assemblies 130, 131 run along opposite sides of the pool. Preferably, each track assembly comprises two parallel cavities, with a profile defining back to back letter "C"s. [DC]. For rectangular pools or spas, it is preferable to mount the assemblies underneath the pool deck. However, it will be appreciated by those skilled in the art that in other embodiments, such as non-rectangular pools or spas, the track assemblies may be mounted on the surface or deck of the pool.

The track assemblies 130, 131 guide the pool cover 100 as it moves across the pool. There are inner (inner designating the portion closest to the pool, outer designating the portion more distant from the pool) receiving cavities in the respective track assemblies 130, 131 which accept the respective side edges 102, 103 of the pool cover 100, allowing the pool cover to slide within the track assemblies. The side edges 102, 103 of the pool cover 100 are beaded to cause each side edge to engage an inner receiving cavity of the respective track assemblies 130, 131. It will be appreciated by those skilled in the art that other known methods of preparing the cover edges for engagement with the track assemblies may also be used. Extending from the end of the pool cover 100 at each of the side edges 102, 103 are lines 44, 45, which are coupled to the cover 100. The lines extend parallel to the track assemblies, such that a first line 44 extends from a first side edge 102 of the pool cover 100, and a second line 45 extends from a second side edge 103 of the pool cover 100. In the preferred embodiment, these lines are constructed of non stretch rope, of the type generally used in yachting. However, it will be appreciated by those skilled in the art that other embodiments may utilize lines of various constructions, such as metal, cotton, nylon or other fibers, or blends of any such fibers or materials, or any other durable non-stretch line material known in the art.

At the end of the pool opposite the drum assembly 20, located at the end of each of the respective track assemblies 130, 131, are return pulleys 150, 151. The lines 44, 45 extend from the respective side edges 102, 103 of the cover 100, run through the inner receiving cavities of the respective track assemblies 130, 131, around the return pulleys, and then through the outer receiving cavities of the respective track assemblies 130, 131 to the end of the pool with the drum assembly 20. At this end, the lines are routed through a system of pulleys and guides to the respective line receiving portions 42, 43 of the reel 40. The first line receiving portion 42 and the second line receiving portion 43 keep the lines 44, 45 from each side of the pool separate from one other.

A system of pulleys and guides route the lines 44, 45 from the first and second track assemblies 130, 131 to the respective portions 42, 43 of the reel 40. It will be appreciated by those skilled in the art that in other embodiments, separate reels are used instead of a single subdivided reel. In this manner, the reel assembly 40 is coupled to the drum assembly 20 by the cover 100 and the lines 44, 45 extending from it. Thus winding the lines 44, 45 onto the reel 40 pulls the cover 100, unwinding it from the drum surface 22, and pulling it across the pool, thereby covering the pool. The lines 44, 45 are wound onto the reel 40 until the cover 100 reaches the opposite end of the pool, fully covering the pool. Thus, in the preferred embodiment, the cover 100 extends from the drum surface 22, across the pool, with the side edges 102, 103 of the pool cover 100 engaged by the inner receiving cavities of the respective track assemblies 130, 131. When fully closed, the cover extends from the drum surface 22 across the pool, but does not go past the return pulleys at the opposite end of the pool. The cover 100 is next wound back onto the drum surface 22, thereby unwinding the lines 44, 45 from the respective line receiving portions 42, 43 of the reel 40, and uncovering the pool as the cover 100 winds onto the drum surface 22.

In its open position, a majority portion of the cover 100 is wound onto the drum surface 22; a portion of the lines 44, 45 remain wound on the respective portions 42, 43 of the reel 40, while the remainder of the lines 44, 45 travel from the reel 40 through the outer receiving cavities of the respective track assemblies 130, 131, around the return pulleys, then through the inner receiving cavities of the respective track assemblies 130, 131 until the lines 44, 45 reach the end of the cover 100, where the lines 44, 45 are coupled to the cover 100. In the preferred embodiment, the lines 44, 45 are sewn to the cover 100. However, it will be appreciated by those skilled in the art that in other embodiments, the lines are glued, mechanically fastened such as by rivets, tied or otherwise attached to the cover, and may be either permanently or removably attached.

Thus when the system is in its open position, the cover is stored on the drum assembly 20, with the lines 44 45 extending from the cover 100, around the return pulleys at the opposite end, and then to the line receiving portions 42, 43 of the reel assembly 40.

In its closed position, a majority portion of the cover 100 is unwound from the drum surface 22; a greater portion of the lines 44, 45 remain wound on the respective line receiving portions 42, 43 of the reel 40, while the remainder of the lines 44, 45 travel from the respective line receiving portions of the reel 40 through the outer receiving cavities of the respective track assemblies 130, 131, around the return pulleys, then a short distance through the inner receiving cavities of the respective track assemblies 130, 131 until the lines 44, 45 reach the cover 100, where the lines are coupled to the cover. Thus when the system is in its closed position, the cover extends from the drum assembly 20, covering the pool. The lines 44, 45 extend the remainder of the distance from the cover to the return pulleys, then travel back to the respective line receiving portions of the reel.

At the first end of the track assemblies, the drum assembly 20, reel assembly 40, and motors 26, 46 are installed. In the preferred embodiment, the drum assembly 20, reel assembly 40, and motors 26, 46 are all installed below grade. However, it will be appreciated by those skilled in the art that in other embodiments, one or more of these components are installed above grade.

As shown in FIG. 1, the drum assembly 20 is installed at a first end of the pool, aligned between but beyond the two track assemblies 130, 131 such that the cover 100 may be pulled between the two track assemblies, with the respective side edges 102, 103 of the cover 100 engaging the respective inner receiving cavities of the track assemblies 130, 131, and the cover 100 may be wound onto the drum surface 22.

Figure 2:
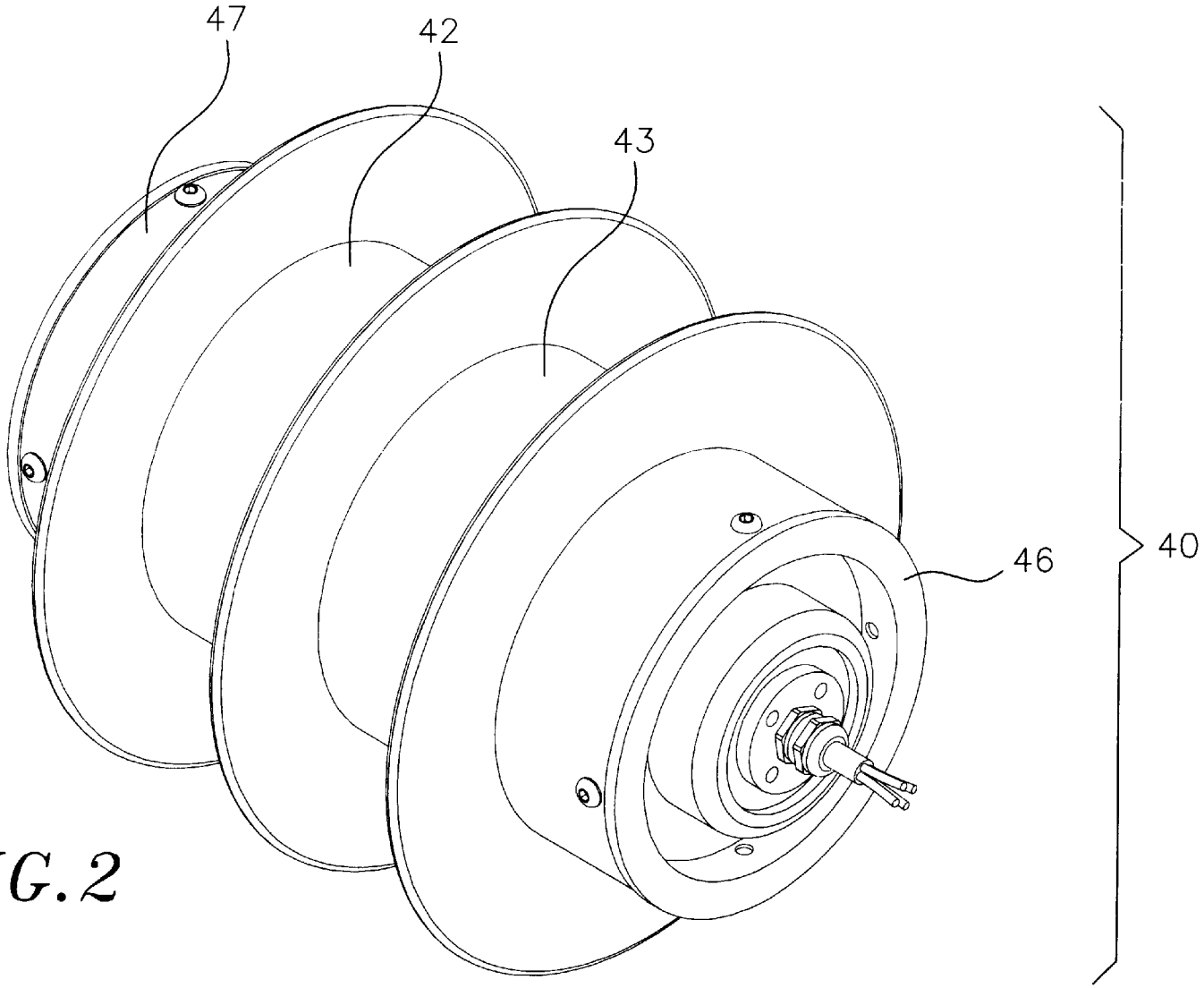
FIG. 2 is a perspective view of the reel assembly of FIG. 1.
Figure 3:
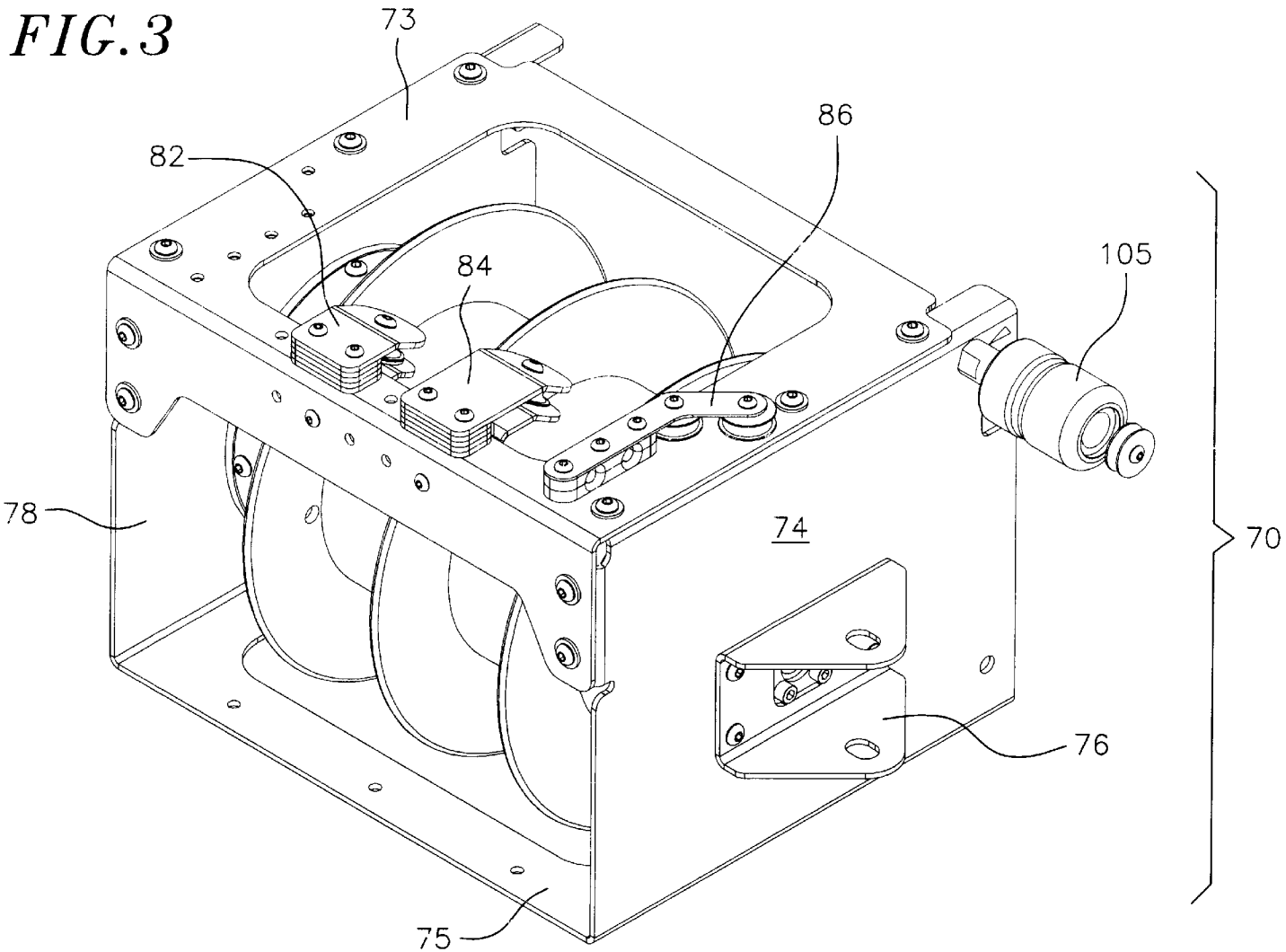
FIG. 3 is a perspective view of the reel mounting assembly of FIG. 1.

In the preferred embodiment, the reel assembly 40 is divided into portions 42, 43 for receiving the lines 44, 45, and is located on one side of the drum assembly 20, as shown in FIG. 2. FIG. 3 illustrates a reel mounting assembly 70, which mounts to the exterior of the end wall of the pool. The reel mounting assembly 70 houses the reel assembly 40, and also provides a point of attachment for a first mounting bracket 76 for a first end of the drum assembly 20. In the preferred embodiment, a motor 46 is housed within the reel assembly 40. In another embodiment, the motor is housed adjacent the reel assembly. In yet another embodiment, there are two reels, each mounted within a reel mounting assembly, each reel having only a single receiving area, and each reel 42, 43 housing its own motor 46, 49. In yet one more embodiment, separate reel motors are housed adjacent to each of two reel mounting assemblies, each coupled to a reel.

Figure 4:
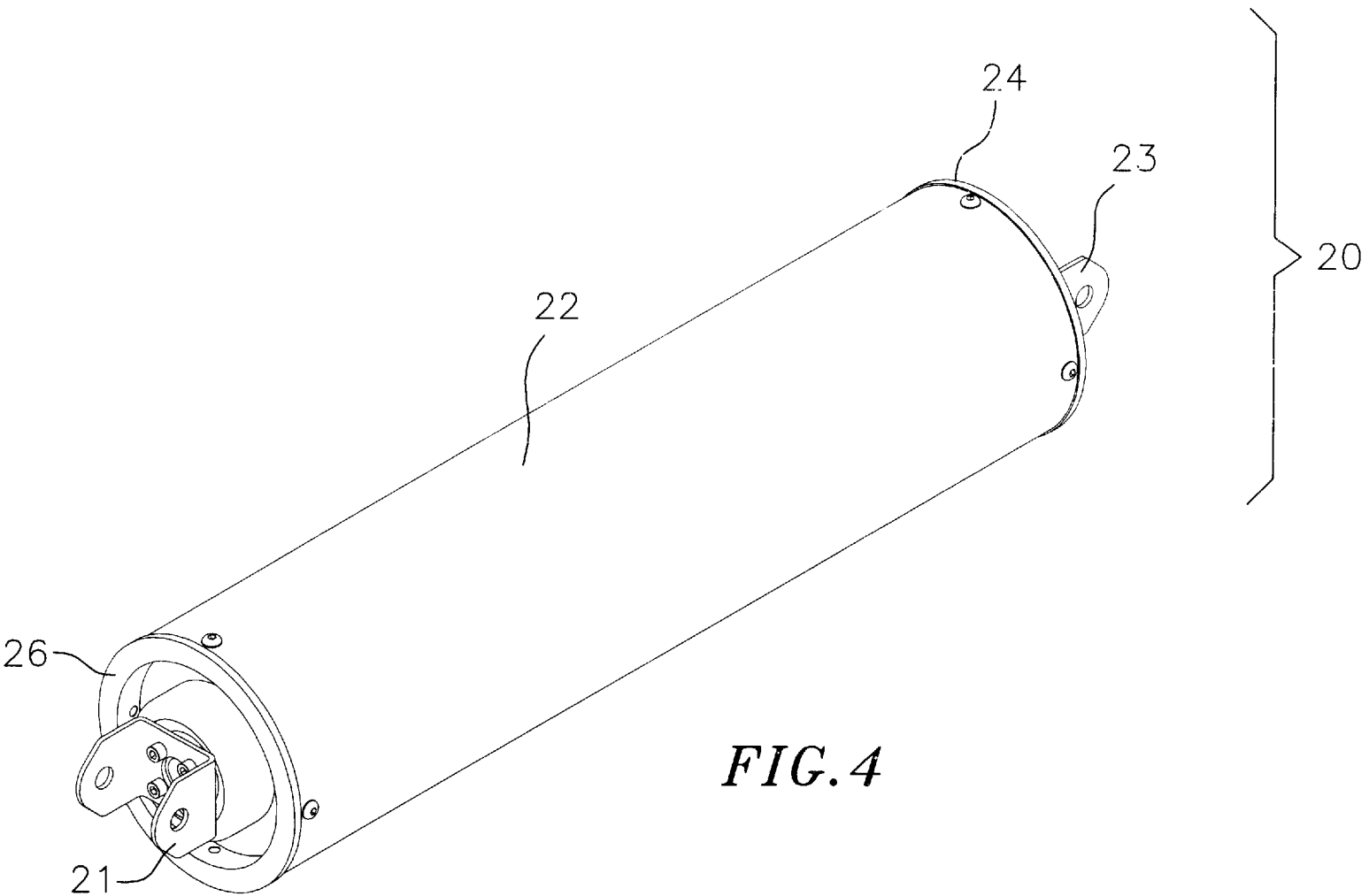
FIG. 4 is a perspective view of the drum assembly of FIG. 1.
Figure 5:
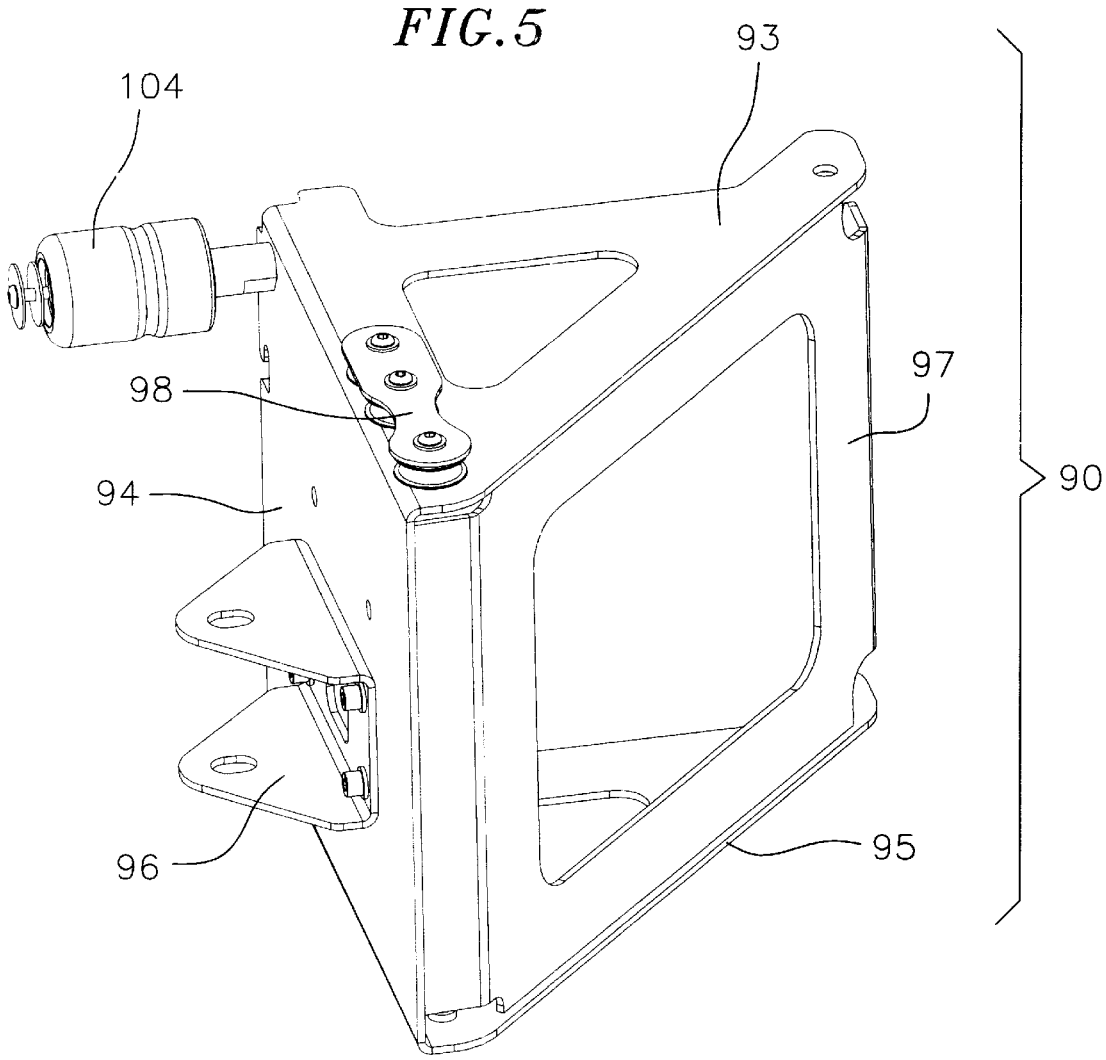
FIG. 5 is a perspective view of the drum mounting assembly of FIG. 1.

FIG. 5 illustrates the drum mounting assembly 90, which is also mounted on the exterior end wall of the pool, offset sufficiently from the reel mounting assembly 70 to mount the drum assembly 20 therebetween. The drum mounting assembly 90 provides a point of attachment for a second mounting bracket 96 for the second end of the drum assembly 20. Preferably, as shown in FIG. 4, the drum assembly 20 has a first and second end for mounting, with a drum surface 22 therebetween. A motor 26, shown in phantom, is housed within the drum assembly 20. In another embodiment, the motor is housed adjacent the drum mounting assembly.

The cover 100 travels from the drum surface 22 to the track assemblies 130, 131 over a pair of roller guides 104, 105. While there are two roller guides in the preferred embodiment, it will be appreciated by those skilled in the art that the number and type of guides may be varied without departing from the spirit and scope of the invention.

Preferably, when the pool cover is in its fully retracted (open) position, the majority of the cover 100 is wound on the drum surface 22, with a sufficient portion extending from the drum surface such that a first side 102 of the pool cover 100 contacts a first roller guide 104 and extends partially into the inner receiving cavity of track assembly 130, and a second side 103 of the pool cover 100 contacts a second roller guide 105, and extends partially into the inner receiving cavity of track assembly 131.

From the end of the cover, the respective lines 44, 45 extend within the inner receiving cavities of the respective track assemblies 130, 131 to the opposite end of the pool. The lines 44, 45 traverse the respective return pulleys 150, 151 then travel back to the first end of the pool within the outer receiving cavity of the respective track assemblies 130, 131. Upon reaching the first end of the pool, the lines 44, 45 are routed through a system of pulleys and guides until the lines reach the respective line receiving portions 42, 43 of the reel 40.

As shown in FIGS. 1 and 3, in the preferred embodiment, two pulley guides 98, 86 receive the respective first and second lines 44, 45, routing the lines through the compensator 60, through the respective angled pulley guides 82, 84, and onto the respective first and second line receiving portions 42, 43, of the reel 40. It will be appreciated by those skilled in the art that the number of guides and pulleys may be varied depending on the particular installation, and other types of guides, such as rollers, pins, dowels, spreaders or any other type of line guide known in the art may also be used.

The first line 44 exits the outer cavity of track assembly 130 and enters into a three pulley assembly 98 mounted on the top 93 of the drum mounting assembly 90. The first line 44 enters on the inside of a first pulley, travels approximately 90° around the first pulley, traverses a second pulley, traveling approximately 180° degrees around the second pulley, and exits on the inside of the second pulley. ("Inside" designates the side of a pulley closest the pool, while "outside" designates the side of a pulley more distal the pool.) The first line 44 then travels through a floating compensator assembly 60, where it traverses a single pulley 180°, thereby reversing its direction and returning to the pulley assembly 98.

The floating compensator assembly 60 is an enclosed assembly containing two pulleys which allow the lines 44, 45 to self-adjust their lengths depending on the force on each line, ensuring that the cover 100 is wound straight on the drum surface 22. The compensator also allows the system to fully close the cover, even if the pool is not "square" and thus the track assemblies are not parallel. For example, if the first side edge 102 of the cover 100 reaches the end of track assembly 130 before the second side edge 103 reaches the end of track assembly 131, the compensator then adjusts and allows the second side edge 103 to be pulled to the end of the track assembly 131, even though the first side edge 102 of the cover has already stopped. Additionally, the compensator simplifies installation of the lines to the reels and the cover.

After leaving the compensator, the first line 44 then returns to the pulley assembly 98, passes 180° around a third pulley, and returns through the compensator assembly 60 to the pulley assembly 86 located on the top of the reel mounting assembly 70. The first line 44 then passes through a guide on pulley assembly 86, passes through a guide portion of angled pulley assembly 84, then enters angled pulley assembly 82, which directs the first line 44 onto the first receiving portion 42 of the reel 40.

The second line 45 exits the outer receiving cavity of track assembly 131 and enters into the pulley assembly 86 mounted on the top of the reel mounting assembly 90. The second line 45 enters on the inside of a first pulley, travels approximately 90° around the pulley, exits the first pulley and enters a second pulley, travels approximately 180° degrees around the second pulley, then exits on the inside of the pulley toward the floating compensator assembly 60. The second line 45 then travels through the floating compensator assembly 60, where it traverses 180° around a single pulley, then returns to the pulley assembly 86. The second line 45 returns to the pulley assembly 86, passes through a guide on pulley assembly 86, then enters angled pulley assembly 84, which directs the second line 45 onto the second receiving portion 43 of the reel 40.

As illustrated in FIG. 3, the reel mounting assembly 70 is coupled to the exterior end wall of the pool. The reel mounting assembly comprises a back 72, ends 74, 78, a top 73, and a bottom 75. In the preferred embodiment, the ends 74, 78 and the bottom 75 are formed from a single piece of material. In another embodiment, the ends 74, 78 and bottom 75 are formed from separate pieces, and the ends 74, 78 are coupled to the bottom 75 by welding. It will be appreciated by those skilled in the art that the ends and bottom could also be coupled by soldering, mechanical fasteners, adhesives, or any other method of coupling known in the art.

The back 72 is coupled to the exterior wall of the pool. In the preferred embodiment, the back 72 is bolted to the exterior wall of the pool. Again, it will be appreciated by those skilled in the art that the back 72 could also be coupled to the wall by screws, nails, other mechanical fasteners, adhesives, or any other method of Coupling known in the art.

The reel assembly 40 is rotatably coupled to an interior surface of the first end 78 of the reel mounting assembly 70 by a bearing 47. The reel assembly 40 extends from the first end 78 toward the interior surface of the opposite end 74. In the preferred embodiment, the reel motor 46 is coupled to the end 74. However, it will be appreciated by those skilled in the art that in other embodiments, the reel motor may be coupled to the first end 78, and may be located anywhere along reel assembly 40, or may even by located outside the mounting assembly 70 and coupled to the reel assembly 40. In one embodiment, the reel motor 46 is of a size and type that may be integrated into the reel assembly 40. However, it will be appreciated by those skilled in the art that in other embodiments, other sizes or types of motors are used.

The exterior surface of the end 74 contains a first drum mounting bracket 76. This drum mounting bracket 76 is coupled to a first end bracket 21 located on a first end of the drum assembly 20. Preferably, the bracket 21 is coupled to the drum motor 26 which is integrated into the drum assembly 20. At the opposite end of the drum assembly is a similar configuration, with a second end bracket 23 coupled to a bearing 24, which is integrated into the drum assembly 20. Extending between the drum motor 26 and the bearing 24 is the drum surface 22, upon which the pool cover is wound and unwound. It will be appreciated by those skilled in the art that in other embodiments, the drum motor may be coupled to the bracket 23, and may be located anywhere along the drum assembly 20, or may even by located outside the drum assembly 20 and coupled to it.

The second end bracket 23 of the drum assembly 20 is coupled to a second drum mounting bracket 96. The second drum mounting bracket 96 is coupled to the exterior of the end 94 of the drum mounting assembly 90. In the preferred embodiment, the drum mounting assembly 90 is triangular in plan view, with a triangular top 93 and bottom 95. The triangular top 93 and bottom 95 are coupled to a back 92, an end 94, and a front 97. While in the preferred embodiment, these components are coupled together by bolts, it will be appreciated by those skilled in the art that the components could also be coupled by screws, other mechanical fasteners, welding, or any other method of attachment known in the art. The back 92 of the drum mounting assembly 90 is coupled to the exterior of the end wall of the pool.

In the preferred embodiment, two roller guides 104, 105 act to keep the pool cover properly positioned, both within the respective track assemblies 130, 131 and on the drum surface 22, as the cover is moved along the track assembly and either wound onto or unwound from the drum surface 22. The roller guides 104, 105 are arranged in line with one another, but spaced linearly apart, in a plane parallel to the drum surface 22. The first roller guide 104 is located on the exterior of the end 94 of the drum mounting assembly 90, while the second roller guide 105 is located on the exterior of the end 74 of the reel mounting assembly 70.

In one embodiment, the motors used are direct current reversible motors, of the flat armature or "pancake" type. However, it will be appreciated by those skilled in the art that other types of motors, such as servo motors, stepper motors, indexing motors, or any type of motor known in the art could also be used, in either A.C., D.C. or non-electrical configurations.

In the preferred embodiment, the motor is a sealed, waterproof unit, containing a system of planetary gear to facilitate revolution of either the reel or drum. Again, it will be appreciated by those skilled in the art that in other embodiments, a separate or independent gear system may also be used, as well as direct drive motors which require no gears.

The motors operate in unison, with the first motor 26 turning the drum assembly 20, and the second motor 46 turning the reel assembly 40. The operation of the motors is directed by an electronic controller unit 14, which controls and regulates operation of the motors based on changes in the electrical current. Line tension, movement limits, and obstructions in the path of the cover may all be controlled through monitoring and manipulation of the current. In the preferred embodiment, both the controller 14 and a power source 10 are located distal from the pool. Power is routed to the controller, which is electrically coupled to the two motors 26, 46 located at the pool. However, it will be appreciated by those skilled in the art that the controller could also be located at the pool, in the same location as the motors. In addition, in another embodiment, there are two independent reels 42, 43 and the motor 46, 49 at each reel, as well as the drum motor, are all electrically coupled to the controller.

In the preferred embodiment, the power source is standard alternating current, which is transformed to direct current at the controller to operate the motors. It will be appreciated by those skilled in the art that typical household voltage may range from approximately 100 V AC to 250 V AC, depending on the location, and that in another embodiment, AC motors are used. It will further be appreciated by those skilled in the art that other power sources, such as a DC battery source, a solar source, or any other electrical source known in the art could also be used, as well as alternative power motor systems, such as hydraulic or pneumatic motors.

Although the invention has been described in detail with reference only to the preferred embodiments, those having ordinary skill in the art will appreciate that various modifications can be made without departing from the spirit and scope of the invention. Accordingly, the invention is defined with reference to the following claims.

What is claimed is:

1. A motorized pool cover system, comprising:

a first reversible electric motor, rotatably coupled to a drum assembly;

a second reversible electric motor, rotatably coupled to a reel assembly, the reel assembly having a first line receiving portion and a second line receiving portion;

wherein the drum assembly and reel assembly are located proximate one another;

a cover, having a first end, and a first side edge and a second side edge, the first end of the cover coupled to the drum assembly;

a first line, coupled to the cover, and extending substantially from the first side edge of the cover;

a second line, coupled to the cover, and extending substantially from the second side edge of the cover;

wherein the first line is coupled to the first line receiving portion of the reel, and the second line is coupled to the second line receiving portion of the reel; and a motor controller, electrically coupled to the first and second motors, and coupled to an electrical power source, wherein the motor controller distributes power to the motors and controls operation of the motors.

2. A cover system as in claim 1, further comprising a first track assembly and a second track assembly, each having an inner receiving cavity, such that the first side edge of the cover may be slidably engaged with the inner receiving cavity of the first track assembly, and the second side edge of the cover may be slidably engaged with the inner receiving cavity of the second track assembly.

3. A cover system as in claim 2, further comprising respective outer receiving cavities along the first track assembly and the second track assembly, wherein the lines extend through the length of the outer receiving cavities of the track assemblies, and extend through a portion of the inner receiving cavities of the track assemblies.

4. A cover system as in claim 1, further comprising a plurality of pulleys which guide the first and second lines to the first and second line receiving portions of the reel.

5. A cover system as in claim 1, further comprising a compensator, having a first pulley which receives the first line, and second pulley which receives the second line, such that differences in force and length of the two lines are equalized.

6. A cover system as in claim 1, further comprising a pair of guides over which the cover is routed, such that the cover is guided onto the drum assembly.

7. A cover system as in claim 6, wherein the guides are rollers.

8. A cover system as in claim 1, wherein the motor controller controls operation of the motors through changes in electrical current.

9. A cover system as in claim 1, wherein the controller is configured to operate the first and second motors simultaneously.

10. A cover system as in claim 1, wherein the controller monitors changes in electrical current to control the motors.

11. A cover system as in claim 1, wherein the controller regulates the electrical current to control the motors.

12. A cover system as in claim 1, wherein the motors are low voltage direct current electric motors.

13. A cover system as in claim 1, wherein the motors are flat armature type motors.

14. A cover system as in claim 1, wherein the first motor is integrated into the drum assembly, and the second motor is integrated into the reel assembly.

15. A motorized pool cover system, comprising:

a first reversible motor, rotatably coupled to a drum assembly;

a second reversible motor, rotatably coupled to a reel assembly;

wherein the drum assembly and reel assembly are located proximate one another;

a cover, having a first end and a second end, and a first side edge and second side edge, the first end of the cover coupled to the drum assembly;

a first line, coupled to the cover, and extending substantially from the first side edge of the cover;

a second line, coupled to the cover, and extending substantially from the second side edge of the cover;

wherein the first and second line are coupled to the reel assembly;

a power source; and a motor controller, coupled to the first and second motors, and coupled to the power source, such that the motor controller distributes power to, and controls operation of, the motors, thereby maintaining tension on the first and second lines, wherein the second reversible motor is coupled to the first portion of the reel assembly, and a third reversible motor is coupled to the second portion of the reel assembly.

16. A motorized pool cover system, comprising:

a pool, having a first end and a second end;

a first track assembly, running from the first end of the pool to the second end of the pool, having a first end and a second end, and an inner receiving cavity proximate the pool, and an outer receiving cavity distal the pool;

a second track assembly, running from the first end of the pool to the second end of the pool, having a first end and a second end, and an inner receiving cavity proximate the pool, and an outer receiving cavity distal the pool;

wherein the first and second track assemblies are parallel;

a first return pulley, located at the second end of the first track assembly;

a second return pulley, located at the second end of the second track assembly;

a first reversible electric motor, rotatably coupled to a drum assembly;

a second reversible electric motor, rotatably coupled to a reel assembly, the reel assembly having a first line receiving portion and a second line receiving portion;

wherein the drum assembly and reel assembly are located proximate one another at the first end of the pool;

a cover, having a first end and a second end, and a first side edge and second side edge, the first end of the cover coupled to the drum assembly;

a first line, coupled to the cover, and extending substantially from the first side edge of the cover through the inner receiving cavity of the first track assembly, around the first return pulley, through the outer receiving cavity of the first track assembly, and coupling to the first line receiving portion of the reel;

a second line, coupled to the cover, and extending substantially from the second side edge of the cover through the inner receiving cavity of the second track assembly, around the second return pulley, through the outer receiving cavity of the second track assembly, and coupling to the second line receiving portion of the reel; and a motor controller, electrically coupled to the first and second motors, and coupled to an electrical power source, such that the motor controller monitors and regulates electrical current to control operation of the motors.

17. A method of covering a pool, comprising:

operating a first reversible electric motor to rotate a drum, thereby unwinding a pool cover from the drum, while simultaneously operating a second reversible electric motor to rotate a reel, thereby winding onto the reel a pair of lines coupled to the pool cover, the combined operation acting to slide the pool cover across the pool, covering the pool.

18. A method of uncovering a pool, comprising:

operating a first reversible electric motor to rotate a drum, thereby winding a pool cover onto the drum, while simultaneously operating a second reversible electric motor to rotate a reel, thereby unwinding from the reel a pair of lines coupled to the pool cover, the combined operation acting to slide the pool cover across the pool, uncovering the pool.

* * * * *